United States Patent [19]

Richard

[11] Patent Number: 4,529,567

[45] Date of Patent: Jul. 16, 1985

[54] PROCESS AND DEVICE FOR MANUFACTURING CONCRETE STRUCTURAL ELEMENTS

[75] Inventor: Pierre Richard, Neuilly sur Seine, France

[73] Assignee: Bouygues, Clamart, France

[21] Appl. No.: 620,883

[22] Filed: Jun. 15, 1984

[30] Foreign Application Priority Data

Jun. 17, 1983 [FR] France ..... 83 10057

[51] Int. Cl.[3] ..... B28B 21/30; B28B 23/06; B28B 7/32

[52] U.S. Cl. ..... 264/228; 425/84; 425/111

[58] Field of Search ..... 425/84, 111; 264/228

[56] References Cited

U.S. PATENT DOCUMENTS

| | | | |
|---|---|---|---|
| 2,210,553 | 8/1940 | Miller | 425/111 |
| 2,550,858 | 5/1951 | Parrett | 425/84 X |
| 2,579,801 | 12/1951 | Crom et al. | 425/84 |
| 3,034,192 | 5/1962 | Maillard | 425/111 X |
| 3,234,619 | 2/1966 | Vitz | 425/111 |
| 3,384,942 | 5/1968 | Shaw et al. | 425/111 |
| 3,583,047 | 6/1971 | Uchiyama | 264/228 X |
| 3,738,786 | 6/1973 | Van Buren | 425/111 |
| 3,822,106 | 7/1974 | Sirera | 425/84 |

*Primary Examiner*—J. Howard Flint, Jr.
*Attorney, Agent, or Firm*—McCormick, Paulding & Huber

[57] ABSTRACT

The invention relates to an apparatus and method for manufacturing concrete structural elements. In order to manufacture the elements, setting of the concrete takes place in a casing (1), while the concrete is compressed with an axial pressure of at least 50 MPa and the casing is surrounded with a hoop (2,3) so as to create transverse planes of pressure.

14 Claims, 2 Drawing Figures

FIG. 1
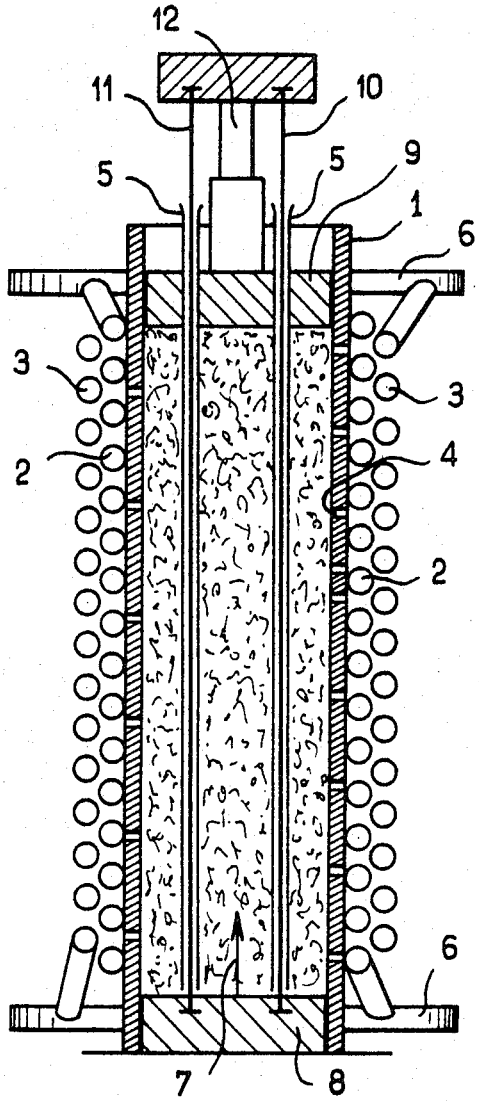
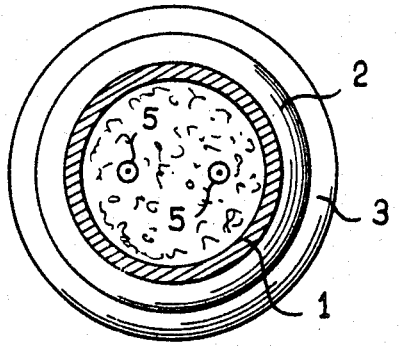
FIG. 2

PROCESS AND DEVICE FOR MANUFACTURING CONCRETE STRUCTURAL ELEMENTS

The invention relates to the manufacture of new concrete structural elements.

One object of the invention is to provide a process for maufacturing, in acceptable industrial conditions, concrete structural elements, in particular beams, having a permissible working load in the range of 50–100 MPa (megapascals) or greater, while the permissible working load of a conventional prestressed concrete beam is of the order of 10–20 MPa.

By compressing fresh concrete, that is before hardening of the concrete, it is possible to increase the permissible working load of concrete, but until now no technique was known for implementing this knowledge in viable industrial conditions.

This is achieved, according to the present invention, by a process in which setting of the concrete takes place in a casing, whilst the concrete is compressed with an axial pressure of at least 50 MPa and the casing is surrounded with a hoop so as to create transverse planes of pressure which combine with the axial pressure so as to produce three-dimensional compression of the concrete.

During axial compression of the concrete, the hoop acts like a high-resistance steel shuttering; it stretches under the effect of compression and, when the concrete has set, it tries to resume its initial state by exercising a compressing effect on the concrete in the transverse planes.

In order to manufacture a rectilinear beam, use is made of a casing which extends along an axis, and the concrete is compressed along this axis, this longitudinal compression creating transverse thrusts in the concrete which tension the hoop around the tubular casing.

Preferably, solely axial pressure is exerted on the fresh concrete, that is pressure which is perpendicular to the thickness of the concrete and parallel to the direction in which the concrete will be stressed when used, but other complementary pressures can also be exerted on the concrete.

Advantageously, during compression, the water is drained from the concrete via one or several tubes introduced inside the concrete.

One object of the invention is also to provide a device for manufacturing structural elements using a process according to the invention.

This device comprises a tubular casing stretching along an axis, means for achieving a hoop around the tube and means for compressing the concrete along the axis of the casing during setting of the concrete.

Preferably, in order to compress the fresh concrete, use is made of one or more cables which are passed through the concrete and by means of which pressure plates located at two opposite ends of the mass of fresh concrete are pulled towards each other, a technique which prevents buckling of the tube during compression.

Advantageously, this cable or these cables is or are passed through one or several drainage tubes.

Subsequently, that is after hardening of the concrete, this prestressing will be retained or decreased or replaced by prestressing cables which pass through this tube or these tubes and ensure connection with the other elements of the concrete structure.

A description follows of an example of such a device with reference to the figures of the attached drawing in which:

FIG. 1 is a longitudinal section through a beam, during manufacture, in accordance with the present invention, and FIG. 2 is a cross-section of the beam shown in FIG. 1.

A cylindrical tube 1, made, for example, of thin sheet metal with a thickness of about 2 mm, of strong cardboard or of plastic, is arranged, preferably vertically, the wall of the tube having multiple drainage holes 4, and this tube is surrounded with a double hoop consisting of two high-resistance steel cables 2, 3 which are wound helically around the tube, in a clockwise direction and anticlockwise direction, respectively. At this point in the process, the winding 2 is in contact with the tube 1 and the winding 3 surrounds the winding 2, but they are not tensioned.

Means are provided for fixing each end of a winding in relation to the corresponding end of the other winding, for example by fixing the two corresponding ends to a means which also makes it possible to retain these ends at one end of the tube 1. An example of such a means consists of a ring which surrounds the tube 1, is fixed in position with respect to the tube 1 and to which are fixed the two corresponding ends of the hooping cables. This ring is denoted by 6 in FIG. 1. Obviously, such a ring exists at either end of the tube 1.

One or several longitudinal drains 5 are arranged inside the tube and these consist preferably of steel tubes which are generally thicker than the tube 1 when the latter is made of steel, that is which have, for example, a wall thickness of 4 to 6 mm.

The material and thickness of the tubular casing 1 are chosen so that the tube spreads the stresses and resists shearing by the hoop.

The ingredients of the concrete, that is, for example, a mixture of aggregates, of sand, of water and of cement, a mixture known per se, are introduced into the space between the outer tube 1 and the drain or drains 5. The aggregates are, a priori, of the same nature as the aggregates of a conventional concrete, but are chosen preferably from the top of the range of aggregates for a concrete rock aggregates which have resistance values ranging between 200 and 300 MPa (certain limestones, sandstones, etc.). The binder can also be a binder such as those used for conventional concretes, including resin-based binders. The percentages of aggregates and binder can be the same as those of conventional concretes.

The mixture is compressed to an axial pressure of 50–100 MPa before and during setting, until hardening of the concrete, from which part of the water has been removed via the holes 4 of the outer tube 1 or via the drain or the drains 5 (it should be noted that the holes 4 may be simple pores).

To achieve the axial pressure whilst avoiding buckling of the tube, it is recommended, according to the invention, that the two plates introduced respectively at one end and at the other end of the tube be brought closer to one another. This is achieved, for example, by means of one or several prestressing cables which pass longitudinally through the concrete and are pulled by a jack. Such a device is represented schematically in FIG. 1 which shows the two pressure plates 8, 9, one of which is pulled towards the other by the cables 10, 11 actuated by a jack 12 which rests on the other plate.

Advantageously, the cables 10, 11 pass through drainage tubes 5.

Compression is achieved in a constant manner or otherwise, and in a continuous manner or otherwise.

Under the effect of the longitudinal compression of the concrete, the hoops stretch and triaxial compression is thus achieved, the hoops producing transverse plane of pressure and the axial pressure producing pressure in the third dimension.

In certain cases, and in particular for beams of great length, the operation can be performed by successive layers of concrete, waiting for one layer to set before making the next layer.

The invention is not limited to a beam with a straight circular cross-section and it extends, for example, to beams with a straight cross-section in the form of a regular polygon or otherwise.

A beam according to the invention, compared to a steel beam, is about twice as light for a permissible working load of the order of half that of steel and it possesses the considerable advantages of the possibility of connections between beams by pouring of a concrete and of assembly with the overall structure by prestressing.

A typical application which comes within the framework of the present invention is the use of beams according to the invention to form three-dimensional trellises for use in bridge structures and the like.

A structural element according to the invention can consist of a beam, a pole, a tie rod or any other part of a concrete structure.

I claim:

1. A process for manufacturing a concrete structural element, comprising: placing concrete in a casing, axially compressing the concrete in said casing (1) while the concrete is setting at an axial pressure of at least 50 MPa, surrounding the casing during the compressing and setting with a hoop (2, 3) so as to create transverse planes of pressure.

2. Process according to claim 1, characterized in that a pressure in the range of 50–150 MPa is used.

3. Process according to claim 2, characterized in that during compression, the water is drained from the concrete via at least one tube (5) introduced inside the concrete.

4. Process according to claim 1, characterized in that, during compression, the water is drained from the concrete via at least one tube (5) introduced inside the concrete.

5. A device for molding a concrete structural element, comprising: a tubular casing (1) which extends along an axis, means (2,3) producing a hoop around the tubular casing and means (8–12) for compressing the concrete along the axis of the casing during setting of the concrete.

6. Device according to claim 5, characterized in that the hoop comprises at least two helical windings (2,3) around the casing, these two windings having winding directions opposite to each other and fixed ends.

7. Device according to claim 6, characterized in that the two ends of the windings (2,3) which are situated at the same end of the tubular casing are fixed to a ring (6) which surrounds the casing (1).

8. Device according to claim 6, characterized in that one of the windings (2) is in contact with the casing (1) and is surrounded by the other winding (3).

9. Device according to claim 5, characterized in that said tubular casing (1) which is designed to spread the stresses and resist shearing by the hoop.

10. Device according to claim 9, characterized in that the said tubular casing (1) is a thin-walled steel tube which, is provided with drainage holes (4).

11. Device according to claim 5, which also comprises at least one tube (5) arranged longitudinally in the concrete so as to drain the water from the concrete during compression.

12. Device according to claim 5, characterized in that the means (8–12) for compressing the concrete comprise pressure plates (8,9) located at the two longitudinal ends of the casing and at least one cable (10,11) passes through the concrete mass longitudinally and exerts on at least one of the plates a pulling effect directed towards the other plate.

13. Device according to claim 12, characterized in that the said at least one cable (10,11) passes through tube (5).

14. Device according to claim 13, characterized in that said at least one cable (10,11) passes through a drainage tube (5).

* * * * *